US006488153B1

(12) United States Patent
Morris

(10) Patent No.: US 6,488,153 B1
(45) **Date of Patent: *Dec. 3, 2002**

(54) CUSHIONING MEMBER

(75) Inventor: John Jay Morris, Vestal, NY (US)

(73) Assignee: International Business Machines Corporation, Armonk, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 581 days.

(21) Appl. No.: 08/979,443

(22) Filed: Nov. 25, 1997

(51) Int. Cl.[7] ..... B65D 85/30
(52) U.S. Cl. ..... 206/523; 206/586
(58) Field of Search ..... 206/588, 592, 206/523, 586, 521; 446/112

(56) References Cited

U.S. PATENT DOCUMENTS 1,894,061 A * 1/1933 Sanders ..... 446/114
2,057,942 A * 10/1936 Fay ..... 446/112
3,166,227 A * 1/1965 Ragnow ..... 206/523
3,572,574 A * 3/1971 Mears ..... 206/586
3,580,469 A * 5/1971 Reese et al. ..... 206/586
3,655,112 A * 4/1972 Jeffers ..... 206/586
3,695,421 A * 10/1972 Wood ..... 206/523
3,708,084 A * 1/1973 Bixler et al. ..... 206/586
3,938,661 A * 2/1976 Carmody ..... 206/523
4,122,946 A * 10/1978 Holley ..... 206/523
4,212,390 A * 7/1980 Raczkowski et al. ..... 206/592
5,007,539 A * 4/1991 Ruter ..... 206/592
5,127,525 A * 7/1992 Hummer ..... 206/586
5,148,920 A * 9/1992 Walker ..... 206/588
5,207,327 A * 5/1993 Brondos ..... 206/523
5,465,838 A * 11/1995 Hollander et al. ..... 206/523

* cited by examiner

*Primary Examiner*—S Thomas Hughes
*Assistant Examiner*—T. Nguyen
(74) *Attorney, Agent, or Firm*—Schmeiser, Olsen & Watts; Lawrence R. Fraley

(57) ABSTRACT

A cushioning member with three interconnecting parts provides a full internal corner for contacting and protecting the external surfaces of an article during shipping and handling. The three interconnecting parts also provide a full external corner. Both full internal and external corners provide a rugged shipping and handling protector for an article (e.g., personal computer) to be shipped.

17 Claims, 8 Drawing Sheets

CUSHIONING MEMBER

TECHNICAL FIELD

This invention relates to cushioning members such as those used for transporting articles (e.g., portable computers, etc.) which protect such articles during such transport and handling associated therewith.

BACKGROUND OF THE INVENTION

For many years, cushioning members have been used to protect corners and surfaces of articles from damage encountered during shipping and handling. Examples are included below.

For example, in U.S. Pat. No. 3,946,874, Breth, et. al, a corner pad is shown which is used in packaging of fragile items contained in a rectangular carton. This pad is composed of three identically shaped resilient or yieldable pieces which, when assembled, provides a three-sided pad with both an open (not filled) internal and external corner for capturing the corner of the package containing a fragile material.

In U.S. Pat. No. 3,994,433, Jenkins, et.al, there is described a four-piece corner pad with an interlocking self contained tab-and-slot structure that permits the corner pad to be set up without the need for any adhesives, tapes, pins, clips, or the like. This structure results only in a partially filled external corner.

Another example is U.S. Pat. No. 5,511,667, Carder, where a honeycomb protector is shown. This protector is composed of a four-piece, foldable, finger and notch assembly which results in a partially filled internal corner.

One more example, a corner protective module, is described by U.S. Pat. No. 3,334,798, Pezely Jr., et. al. This patent reveals a set of packaging modules, one embodiment of which is a corner protective module made of absorbing material having three identical interlocking tongue and groove portions, which when positioned about an article to be packaged forms a corner protector about the article, having an open external corner.

French Patent No. 2,538,351, describes a four-piece packaging corner protector with three walls, each wall being connected to each adjacent wall by a membrane which serves as a hinge permitting the three walls to be adjusted from a flat sheet into a corner protector. One of the walls has two parts, tenon and a mortice, for interlocking purposes.

A cushioning member that both minimizes the number of parts provided to assemble the member and which forms an assembly with a full internal corner (and external corner, if needed) for assuring maximum protection to the article being handled and shipped as defined herein below, has hitherto not been provided. To solve this problem, an improved cushioning member with a full internal corner (and external corner, if needed) utilizing a relatively few number of parts, has been developed. It is believed that such a cushioning member will constitute a significant advancement in the art.

OBJECTS & SUMMARY OF THE INVENTION

It is, therefore, a primary object of this invention to provide a cushioning member that both minimizes the number of parts provided to assemble the member and which forms an assembly with a full internal corner (and external corner, if needed).

It is another object of this invention to provide cushioning members for maximum protection of an article during shipping and handling.

It is yet another object of this invention to provide cushioning members which are easily manufactured from a predetermined blank and composed of compressible material which allows for conformance of projections in cavities and for easy assembly requiring no adhesives, taping, or other means to hold the assembled parts together.

In accordance with one aspect of this invention, there is provided a cushioning member for engaging the external surfaces of an article having first, second and third interconnecting parts, wherein each interconnecting part is adapted for contacting a respective one external surface of the article. These parts are then connected together in such a manner so as to define a substantially full interior corner against which the article can be positioned in a substantially flush orientation.

The invention will be explained in detail below with the following drawings and detailed description.

BEST MODE FOR CARRYING OUT THE INVENTION

For a better understanding of the present invention together with the other and further objects, advantages and capabilities thereof, reference is made to the following disclosure and appended claims in connection with the above-described drawings.

Figure 1:
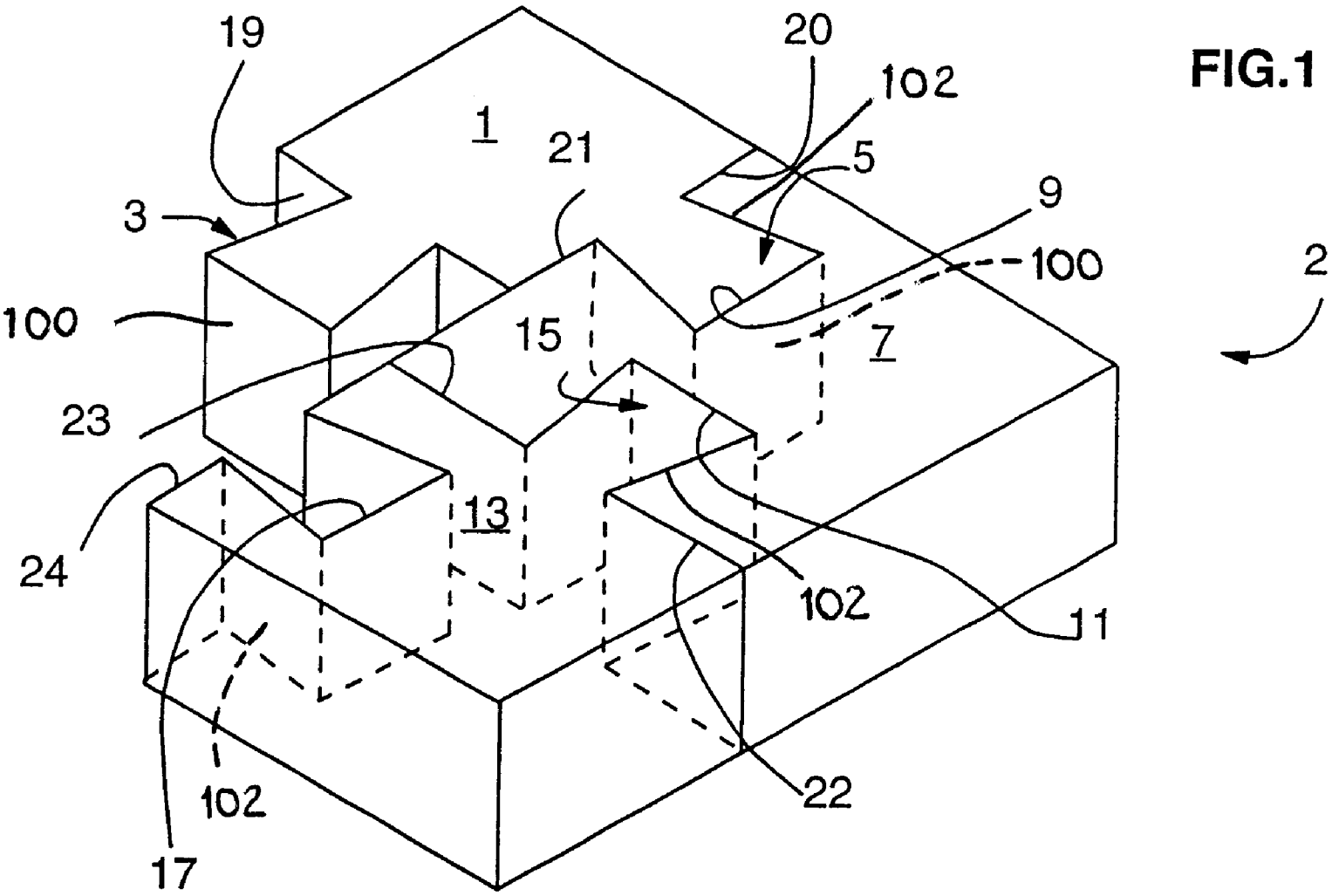
FIG. 1 is a perspective view of the blank from which first, second, and third interconnecting parts of the invention are formed.

In FIG. 1, there is shown the flat view of the blank sheet 2 of expanded compressible foam material from which the interconnecting parts of this invention are formed (e.g., cut). Examples of expanded compressible foam from which these interconnecting parts can be cut are polyethylene, polyurethane, polystyrene or polypropylene having a density of about 1.0 to about 6.0 pounds per cubic foot (lbs./ft$^3$). In the preferred embodiment, the material is polyethylene with a density of about 1.2 lbs/ft$^3$ and a thickness of about 2 inches. Expanded compressible foam can be defined as a plastic resin material which has open or closed celled air spaces that were introduced by expansion or by blowing agents during manufacturing so the material can be used as a cushion. An example of the preferred embodiment of the invention described herein assembled from the blank 2, in FIG. 1, has a width and length each of about 10 inches with a height of about 2 inches. This size is particularly well suited for shipping applications such as TVs, computers, printers, banking machines, furniture, etc. Another application used to package and ship articles such as computer DASD devices can also be assembled from a blank 2 such as depicted in FIG. 1 having a width and length each about 8 inches with a height of about 3 inches. The size in the length and width dimension is determined by the weight of the article being shipped and the spring rate of the foam, while the thickness is determined by the ruggedness of the article being protected. More fragile items such as computer DASD devices would typically require thicker foam.

Referring to FIG. 1, it can be seen that the blank sheet of expanded foam material can be die cut into three interconnecting parts. The first, second and third parts 1, 13, and 7 respectively each include at least two surfaces, part 1 having surfaces 19 and 20, part 13 having surfaces 23 and 24, and part 7 having surfaces 21 and 22. The first interconnecting part 1 includes a first projection 3 and a second projection 5, each extending outwardly from one of the part's surfaces 19 and 20 respectively. The second interconnecting part 13 includes a first projection 15 extending outwardly from one of the surfaces 23 of the second interconnecting part and further includes a first cavity 17 in another of the surfaces 24 of this second interconnecting part. The third interconnecting part 7 includes a first cavity 9 and a second cavity 11, the first cavity being located in one of the surfaces 21 of part 7 and the second cavity 11 being located in another of the surfaces 22 of this third interconnecting part. In the preferred embodiment, the projections extending outwardly from the first, second and third interconnecting parts are each substantially of the shape of trapezoids. As clearly illustrated in FIG. 1, each of the projections 3, 5, and 15, includes an end face 100 having a rectangular profile. Further, each of the cavities 9, 11, and 17, includes side openings 102 having a trapezoidal profile. Other shapes can be utilized, e.g., truncated pyramids or cubical. The cavities referred to above each having the shape substantially of a trapezoid are particularly adapted for having the projections (which are compressible) of the first and second interconnecting parts securely positioned therein in a locking form of engagement. The blank form with die cut interconnecting parts has the advantage over molded parts in that these can be more easily and inexpensively produced. Since the interconnecting parts are formed from blanks of material, the parts are also very easy to ship and store (e.g., in a stacked, flat arrangement).

Figure 2:
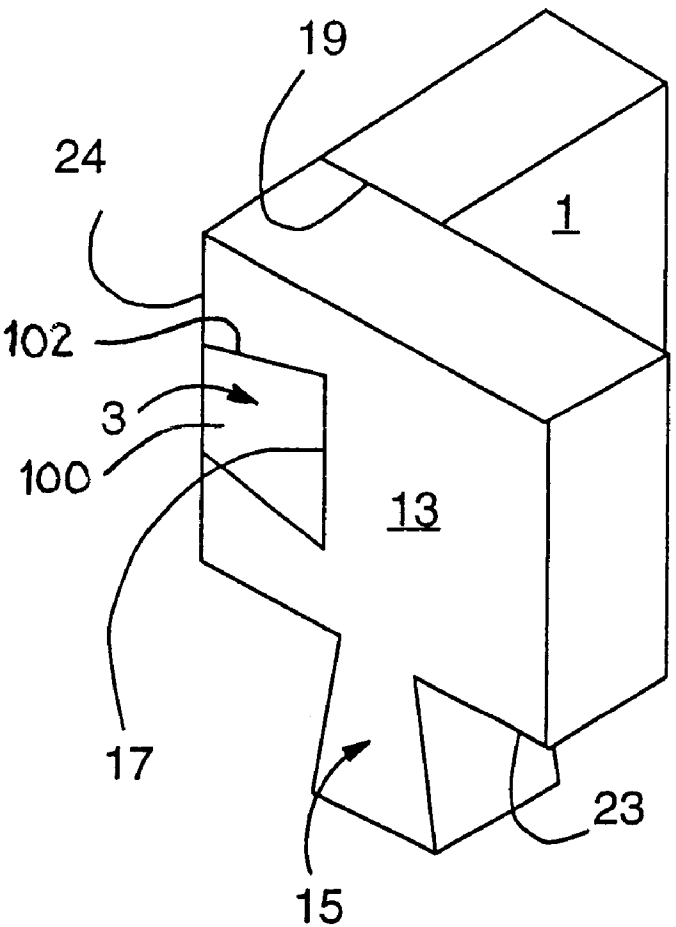
FIG. 2 is a view of a partly assembled cushioning member of the invention illustrating the working relationship of the invention's first and second interconnecting parts.

In FIG. 2, there is shown a partially assembled cushioning member intended to illustrate the working relationship of the invention's first and second interconnecting parts wherein the first projection 3 of the first interconnecting part 1 is securely positioned within the first cavity 17 of the second interconnecting part 13.

Figure 3:
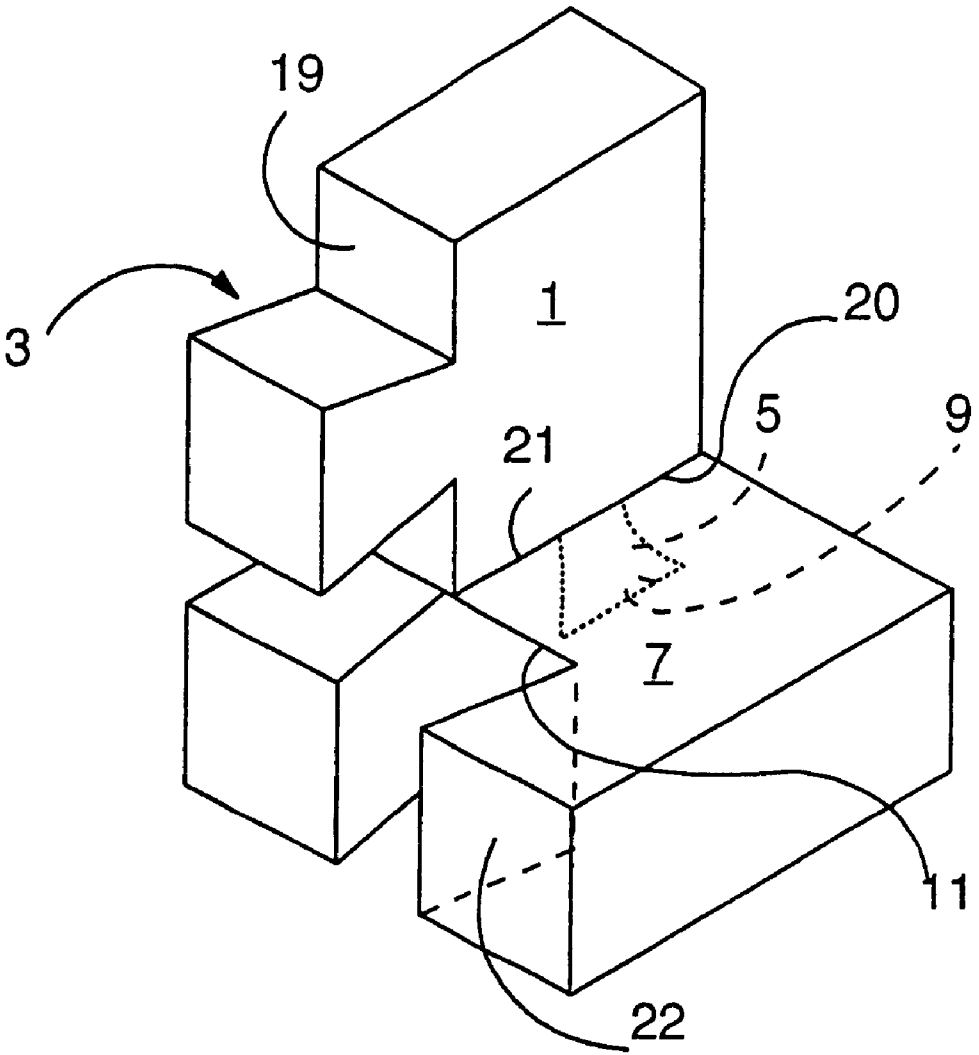
FIG. 3 is a view of a partly assembled cushioning member of the invention illustrating the working relationship of the invention's first and third interconnecting parts.

In FIG. 3, there is shown another partly assembled cushioning member intended to illustrate the working relationship of the invention's first and second interconnecting parts wherein the second projection 5 of the first interconnecting part 1 is securely positioned within the second cavity 9 of the third interconnecting part 7.

Figure 4:
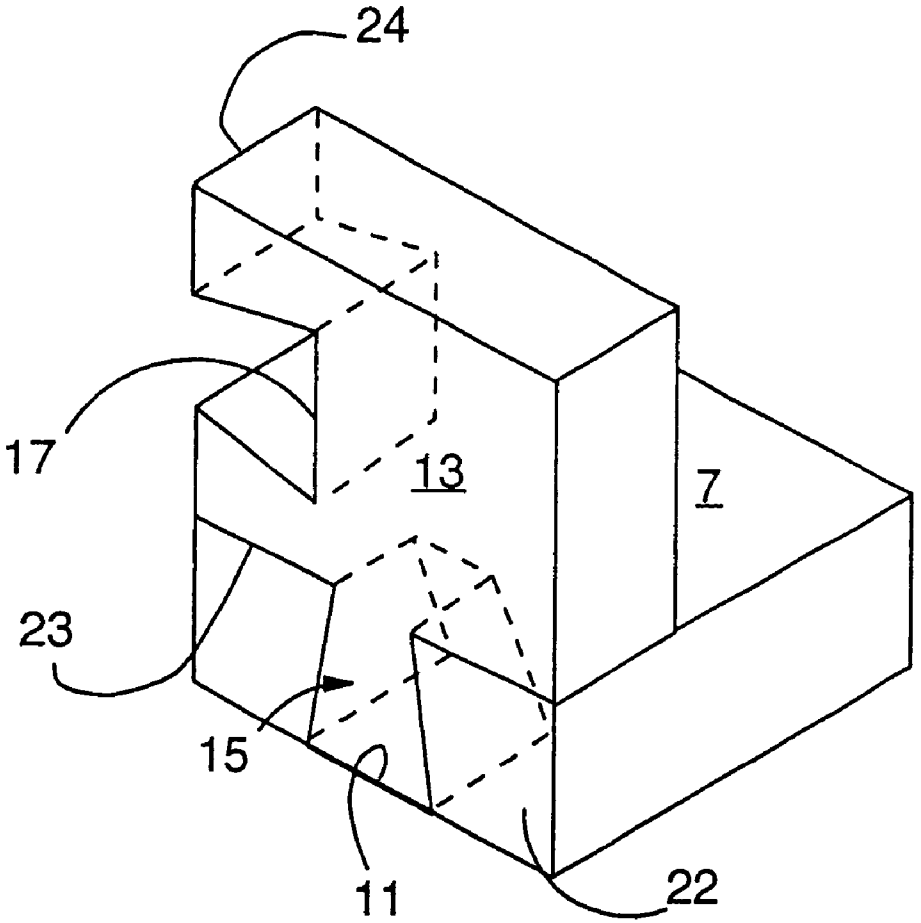
FIG. 4 is a view of a partly assembled cushioning member of the invention illustrating the working relationship of the invention's second and third interconnecting parts.

In FIG. 4, yet another partly assembled cushioning member is shown intended to illustrate the working relationship of the invention's first and second interconnecting parts wherein this cushioning member includes the first projection 15 of the second interconnecting part 13 securely positioned within the first cavity 11 of the third interconnecting part 7.

Figure 5:
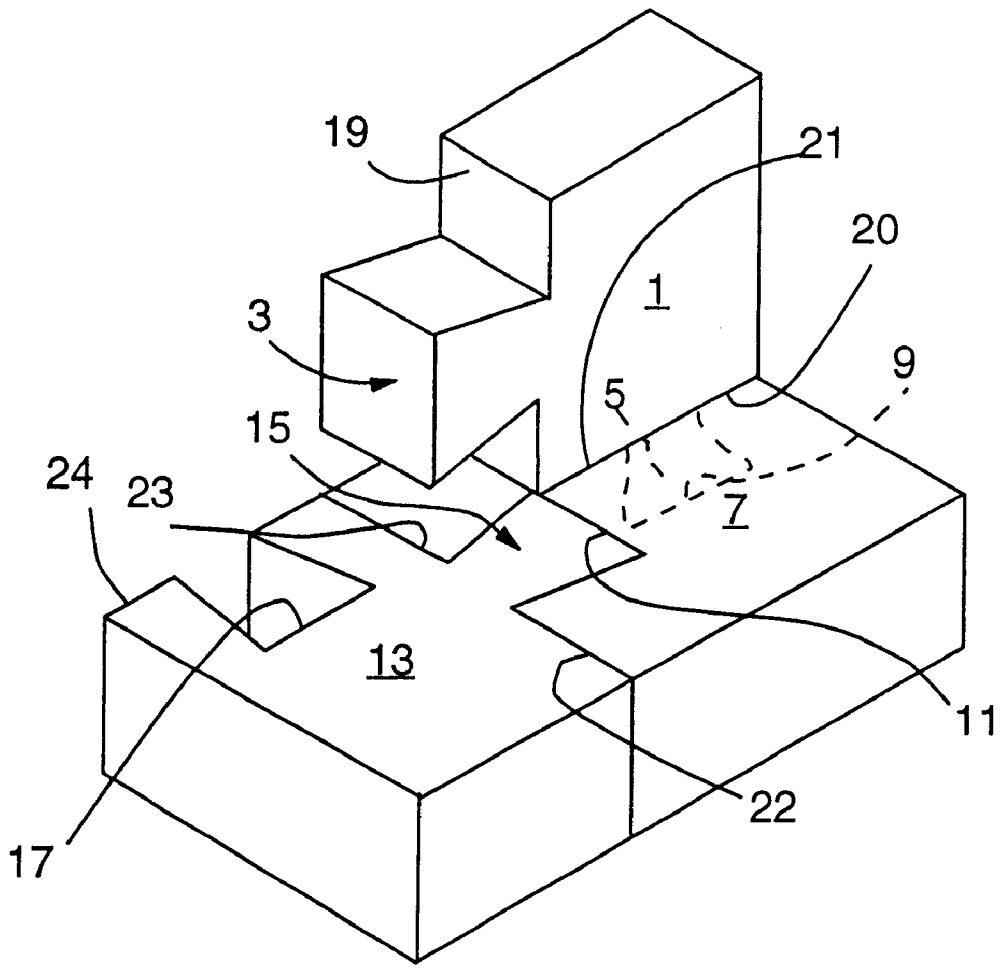
FIG. 5 is a view of the three interconnecting parts of the invention during initial assembly.
Figure 6:
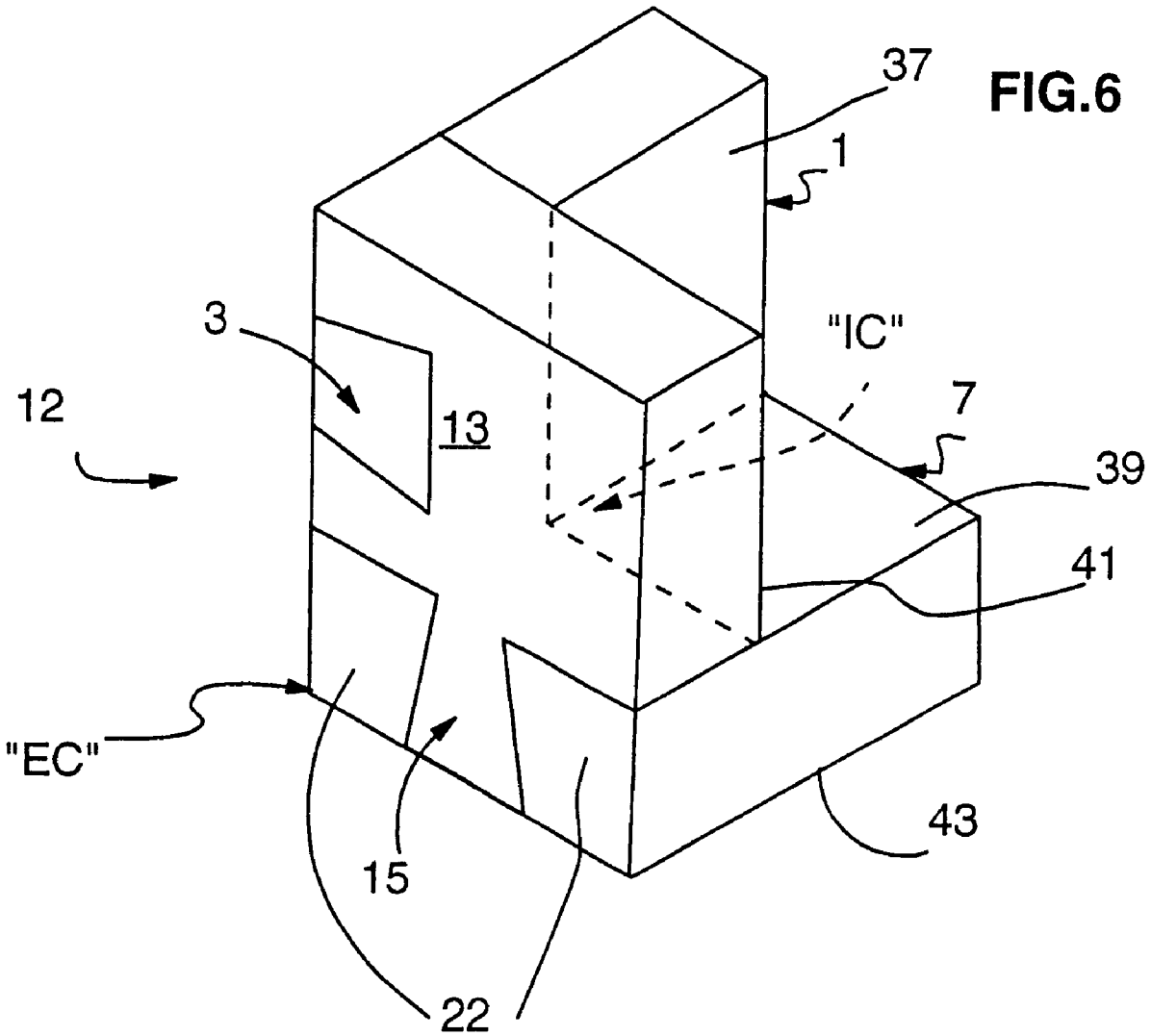
FIG. 6 is a fully assembled cushioning member with a full internal corner ("IC") and a full external corner ("EC"), in accordance with one embodiment of the invention.

In FIG. 5, there is shown a partly assembled cushioning member of the invention which depicts the detail associated with the full assembly view in FIG. 6. The interconnecting parts and the compressible foam material, when engaged together, require no tape, adhesives or other means to hold these parts in position. Also, it should be noted at this point that this interconnecting structure is attained without use of slit score hinges. A slit score hinge is defined as a slit passing substantially through a thickness of a sheet, but leaving a small portion of the sheet which provides a self hinge in the base material. In FIG. 5, the partial assembly shows the second projection 5 of the first interconnecting part 1 positioned within the second cavity 9 of the third interconnecting part 7. By further positioning the first projection 3 of the first interconnecting part 1 within the first cavity 17 of the second interconnecting part 13, and the first projection 15 of the second interconnecting part 13 within the first cavity 11 of the third interconnecting part 7, it can easily be seen how the cushioning member 12 comprising the preferred embodiment of this invention, shown in FIG. 6, is obtained.

The positioning of projections (trapezoids) into cavities of the shape described causes a slight compression of the projections and a slight expansion and deformation of the cavities. This occurs because the rectangular end face 100 of a projection is inserted into the trapezoidal side opening 102 of a cavity (see e.g., FIG. 2). The difference in the profiles of the rectangular end face 100 of the projection and the trapezoidal side opening 102 of the cavity causes the slight compression of the projection and the slight expansion and deformation of the cavity. The preferred compressible foam material, polyethylene contains a semi-rough texture throughout. The surface of the projections and the walls of the cavities both include this semi-rough texture. This semi-rough texture aides significantly in the creation of frictional forces between the projections and cavities during positioning of the projections into the cavities. Upon positioning of the projections into the cavities, the slight compression of the projections coupled with the slight expansion and deformation of the cavities together with the frictional force created by the semi-rough texture of the polyethelene creates a tight interlocking bond thereby allowing assembly without need for tape, adhesives or other means to hold these interconnecting parts in position.

In FIG. 6, there is shown the first, second, and third interconnecting parts 1, 13 and 7 connected to form cushioning member 12 so as to define a full internal corner "IC", ideally suited for contacting the corresponding external surfaces of an article in a substantially flush manner. This full internal corner, "IC", is provided by the intersection of planar surface 37 of the first interconnecting part 1, the planar surface 41 of the second interconnection part 13, and the planar surface 39, of the third interconnecting part 7. This member also provides a full external corner "EC". This full external corner, "EC" is provided by the intersection of one of the surfaces 22 of the third interconnecting part 7 with the planar surface 43 of the third interconnecting part 7. The full internal and external corners assure a ruggedized structure which provides maximum protection for an article during even relatively rough shipping and handling. The simplicity of this design and the ability thereof to adapt the thickness of the various interconnecting members comprising the cushioning member allow this invention to be ideally suited to many applications where cushioning is needed.

Figure 7:
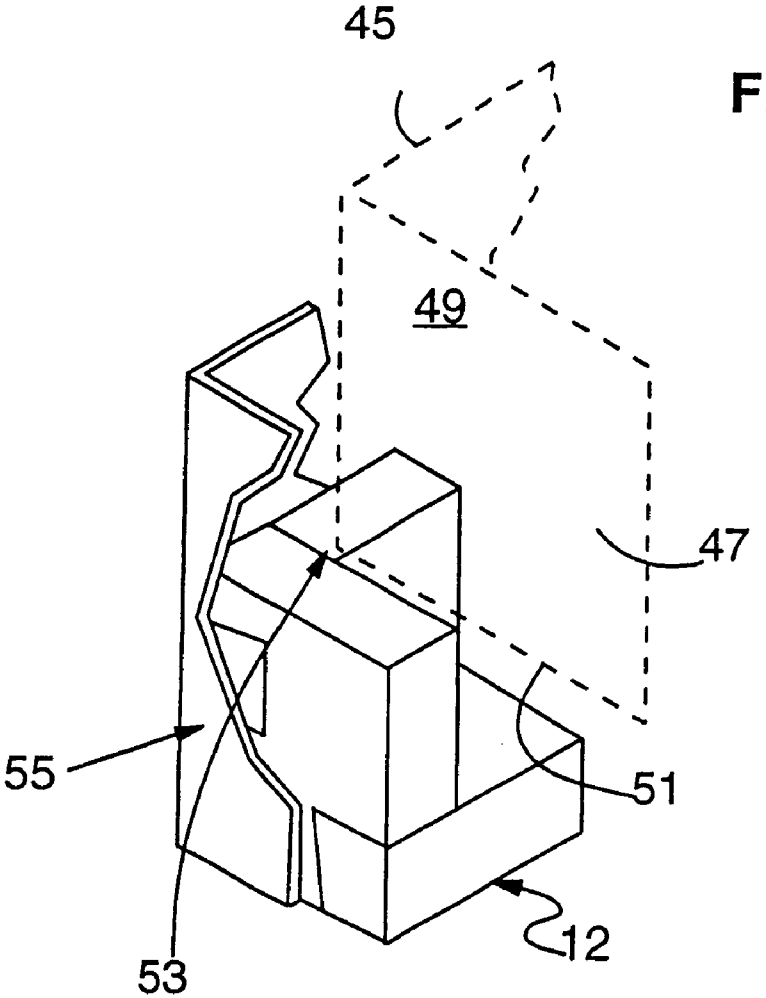
FIG. 7 depicts use of the cushioning member of the invention in contact with the external surface of an article which is inserted into a shipping container.

In FIG. 7, there is shown an example of one application of the invention for contacting external surfaces 45 and 47 (and bottom surface 51, if present) of an article 49 which has a projecting corner 53. The cushioning member of this invention is adapted for engaging an article's external surfaces in a substantially flush manner. The invention thereby provides rugged protection while article 49 is shipped and otherwise handled while in container 55 (e.g., a reinforced cardboard box).

Figure 8:
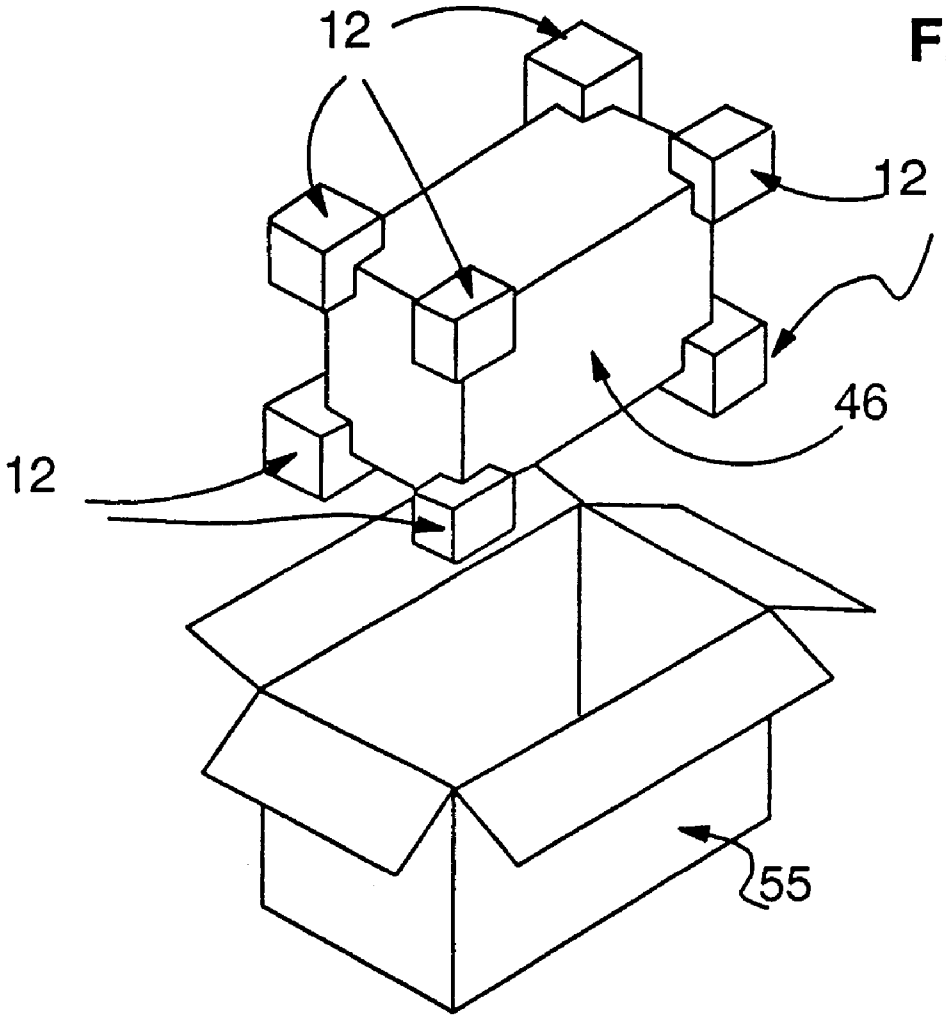
FIG. 8 illustrates use of a plurality of cushioning members of the invention to protect the corners of a box-like article being prepared for shipping.

In FIG. 8, there is shown a box-like article 46 (e.g., computer) having six external surfaces, prepared for insertion into a shipping container 55 with the box-like article 46 having attached thereto eight cushioning members which function as corner protectors in accordance with the teachings herein.

While there have been shown and described what are at present considered the preferred embodiments of this invention, it will be obvious to those skilled in the art that various changes and modifications can be made therein without departing from the scope of the invention as defined by the appended claims.

What is claimed is:

1. A cushioning member, comprising:

first, second, and third interconnecting parts, each of the interconnecting parts being perpendicularly attachable to the other two parts, wherein the first interconnecting part comprises a projection that is perpendicularly attachable to a cavity in the second interconnecting part, wherein an end face of the projection has a different profile than a side opening of the cavity when the first and second interconnecting parts are perpendicularly arranged, and wherein the end face of the projection is and remains deformed and compressed within the cavity when the first and second interconnecting parts are perpendicularly attached.

2. The cushioning member of claim 1 wherein said two, and third interconnecting parts each includes at least two surfaces.

3. The cushioning member of claim 2, wherein said first interconnecting part includes first and second projections, each of said projections extending outwardly from a respective one of said surfaces of said first interconnecting part.

4. The cushioning member of claim 3, wherein each of said projections is substantially of the shape of a trapezoid.

5. The cushioning member of claim 2, wherein said second interconnecting part includes a first projection extending outwardly from one of said surfaces of said second interconnecting part, the cavity being in another of said surfaces of said second interconnecting part.

6. The cushioning member of claim 2, wherein said third interconnecting part includes first and second cavities, said first cavity being located in one of said surfaces of said third interconnecting part, said second cavity being located in another of said surfaces of said third interconnecting part.

7. The cushioning member of claim 2, wherein said first interconnecting part includes two projections, each of said projections extending outwardly from a respective one of said surfaces of said first interconnecting part, said second interconnecting part includes a first projection extending outwardly from one of said surfaces of said second interconnecting part, the cavity being in another of said surfaces of said second interconnecting part.

8. The cushioning member of claim 2, wherein said first interconnecting part includes two projections, each of said projections extending outwardly from a respective one of said surfaces of said first interconnecting part, said third interconnecting part includes first and second cavities, said first cavity being located in one of said surfaces of said third interconnecting part, said second cavity being located in another of said surfaces said second projection of said first interconnecting part securely positioned therein.

9. The cushioning member of claim 2, wherein said second interconnecting part includes a first projection extending outwardly from one of said surfaces of said second interconnecting part, the cavity being in another of said surfaces of said second interconnecting part, said third interconnecting part includes first and second cavities, said first cavity being located in one of said surfaces of said third interconnecting part adapted for having said first projection of said second interconnecting part securely positioned therein, and a second cavity being located in another of said surfaces of said third interconnecting part.

10. The cushioning member of claim 1 wherein said cushioning member is comprised of a compressible material.

11. The cushioning member of claim 10, wherein said compressible material comprises a foam.

12. The cushioning member of claim 11 wherein said foam is expanded foam.

13. The cushioning member of claim 12 wherein said expanded foam comprises polyethylene, polyurethane, polystyrene or polypropylene.

14. The cushioning member of claim 13 wherein said expanded foam density is about 1.0 pounds per cubic foot to about 6.0 pounds per cubic foot.

15. The cushioning member of claim 1, wherein said first, second, and third interconnecting parts further define a substantially full external corner.

16. The cushioning member of claim 15, wherein said cushioning member is adapted for engaging an article of boxlike configuration.

17. The cushioning member of claim 16, wherein said boxlike article includes six external surfaces.

* * * * *